United States Patent [19]

Gilbert

[11] 4,010,888

[45] Mar. 8, 1977

[54] SMALL ANIMAL CARRYING CASE

[75] Inventor: Earl F. Gilbert, Farmington Hills, Mich.

[73] Assignee: Westvaco Corporation, New York, N.Y.

[22] Filed: Apr. 5, 1976

[21] Appl. No.: 673,920

[52] U.S. Cl. ..... 229/52 B; 229/6 A; 119/19; 229/17 B

[51] Int. Cl.[2] ..... B65D 5/46

[58] Field of Search ..... 229/6 A, 52 B, 17 R, 229/32; 119/18, 19, 72

[56] References Cited

UNITED STATES PATENTS

| | | | |
|---|---|---|---|
| 315,925 | 4/1885 | Evans | 119/18 X |
| 1,029,144 | 6/1912 | Rich | 119/19 |
| 2,007,810 | 7/1935 | Oman | 229/52 B |
| 2,325,277 | 7/1943 | Rothe et al. | 229/17 B X |
| 2,422,438 | 6/1947 | Richards | 119/72 X |
| 2,714,982 | 8/1955 | Strauss | 229/52 B X |
| 2,761,423 | 9/1956 | Heidler | 119/72 |
| 3,013,710 | 12/1961 | Kronsom et al. | 229/32 |
| 3,141,596 | 7/1964 | Murphy | 229/17 R |
| 3,194,480 | 7/1965 | Maindron | 229/52 B |
| 3,255,950 | 6/1966 | Marcouly | 229/52 B |
| 3,780,934 | 12/1973 | Gardner | 229/52 B |

*Primary Examiner*—Davis T. Moorhead

[57] ABSTRACT

A shipping container for small animals or the like is prepared from a cut and scored blank of paperboard that can be shipped and stored in knocked down condition, but readily set up to form an enclosure having main and side walls said container having top closure flaps arranged to form a combination top closure locking means and integral handle, the container further including a means at one corner of the lower end thereof for retaining and permitting external access to a cup or the like into which food or water may be placed.

4 Claims, 10 Drawing Figures

FIG 1.
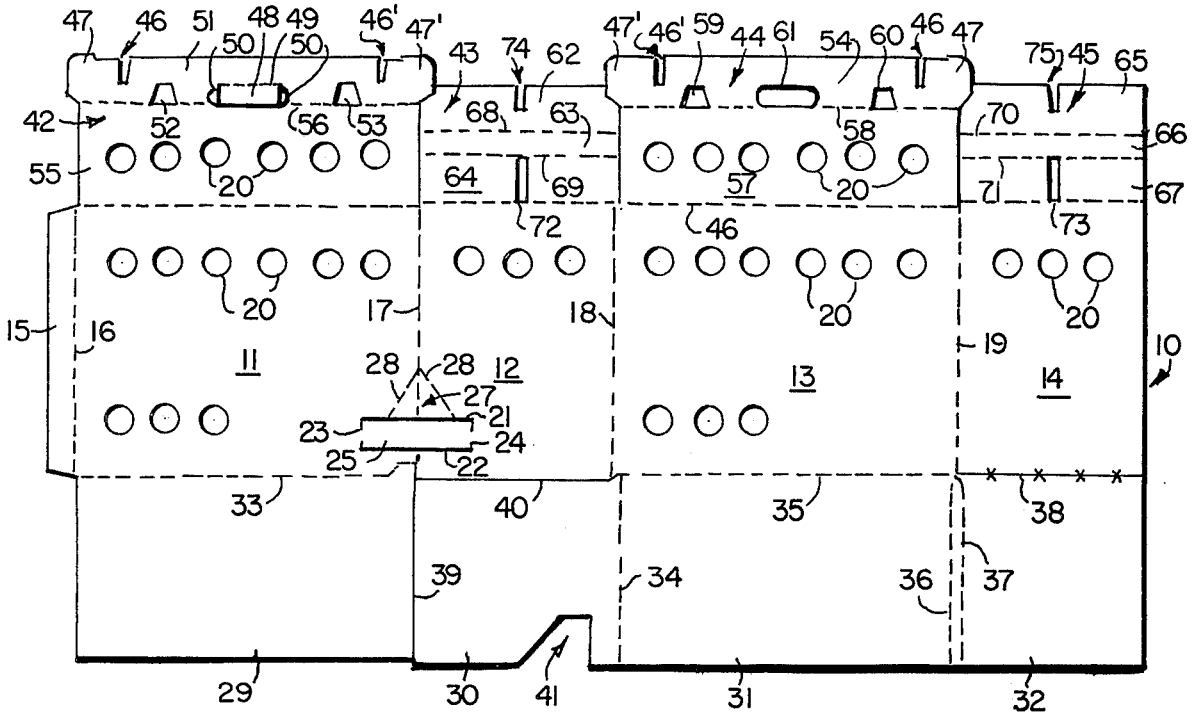
FIG 2.
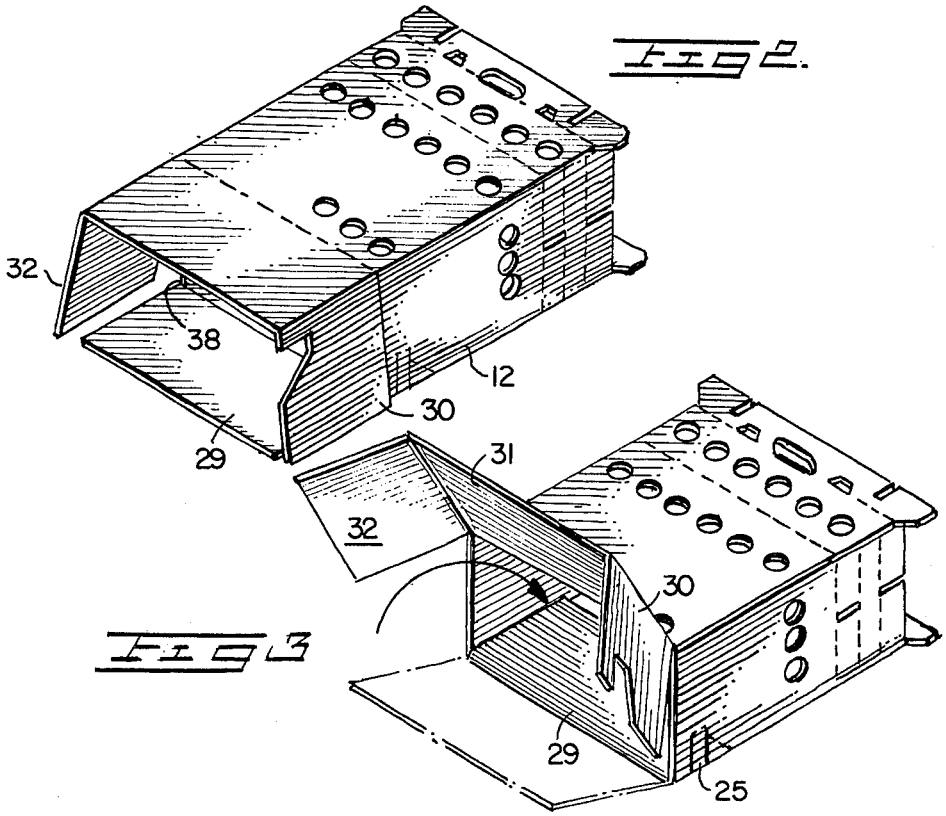
FIG 3

Fig 4.
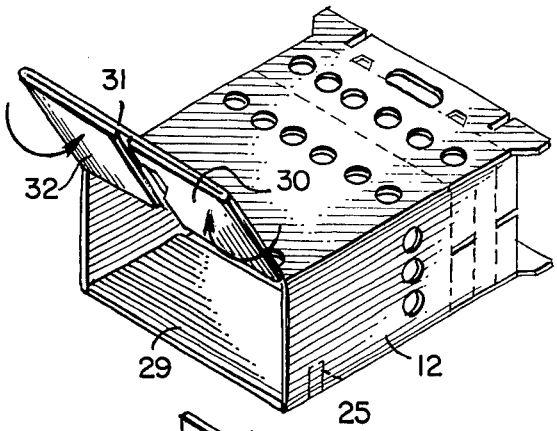
Fig 5
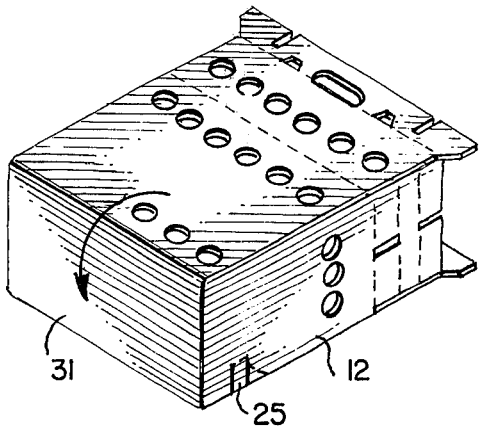
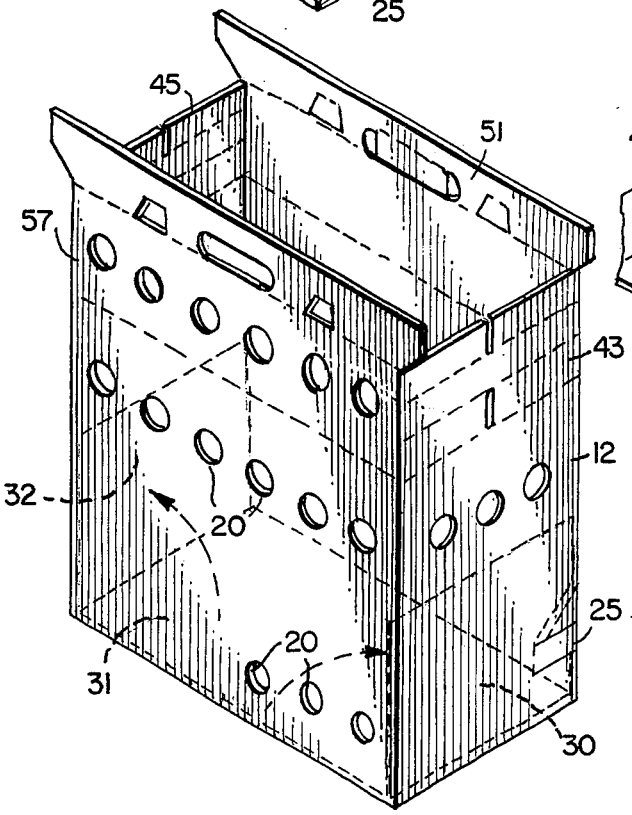
Fig 6
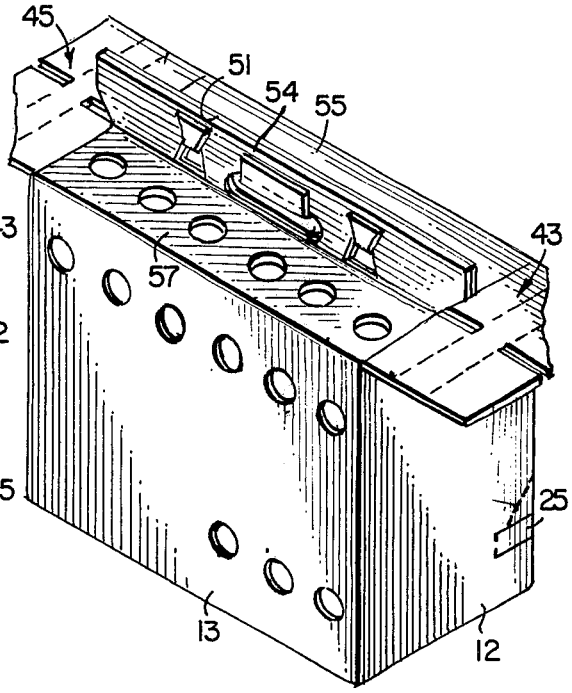
Fig 7.

SMALL ANIMAL CARRYING CASE

BACKGROUND OF INVENTION

The present invention relates in general to a shipping container having an integral handle and an effective top closure locking means. In particular, the present invention relates to a shipping container for transporting small animals. The container is prepared from a single blank of cut and scored paperboard or the like that is assembled for shipment and storage in a knocked down condition but which is readily set up at the point of use. The blank includes perforations and vent holes strategically placed to provide adequate ventilation for the animal shipped therein and includes a provision for accepting and securely retaining a cup or other means into which food or water may be placed for sustaining the animal.

Containers of the type disclosed herein are known in the prior art particularly as represented by the following prior U.S. Pat. Nos.:

315,925
2,422,438
2,761,423

Moreover, containers of the same general form as the shipping container disclosed herein (but not for the same purpose disclosed herein) are also known in the art as represented by the following prior U.S. Pat. Nos.:

2,007,810
2,714,982
3,194,480
3,255,950

However, applicant is the first to incorporate in a single shipping container all of the desirable features necessary to produce a successful carrying case for small animals.

SUMMARY OF INVENTION

The present invention relates to a shipping container for transporting small animals. The container is prepared from a single blank of paperboard or the like that is desirably but not necessarily coated with a water resistant finish. For instance, coated corrugated paperboard identified by the tradename COTE-A-COR 600 and supplied by Westvaco Corporation may be used for the blank of the present invention. The blank is cut and scored to provide the usual side wall panels normally associated with a shipping container of the type disclosed, but further includes a provision for forming a multiple wall bottom for the container, various cuts and scores for providing an integral handle for the container, a positive top locking feature, ventilation openings for the animal transported therein and a cut-out in one corner of a lower end thereof for retaining an animal feeding/watering receptacle inside the container which is accessable from outside the container. The blank is folded and partially assembled at the point of manufacture by any desirable means such as tape, staples or the like and then shipped to the user in a knocked down condition for set up at the point of use. The advantages of the shipping container of the present invention over those of a similar type include more economical construction, minimum storage space in the unused condition and a lighter weight construction which still produces a rigid and convenient carrying handle for transporting a small animal.

DESCRIPTION OF DRAWING

FIG. 1 shows in plan a typical blank structure for fabricating the shipping container of the present invention;

FIGS. 2–6 show in perspective views the steps for forming the double wall bottom of the shipping container;

FIGS. 7–9 show in perspective views the steps for folding, assembling and locking the integral carrying handle for the shipping container; and, FIG. 10 is a partial perspective view showing the means for retaining the feeding/watering receptacle in place in the container.

DETAILED DESCRIPTION

Figure 8:
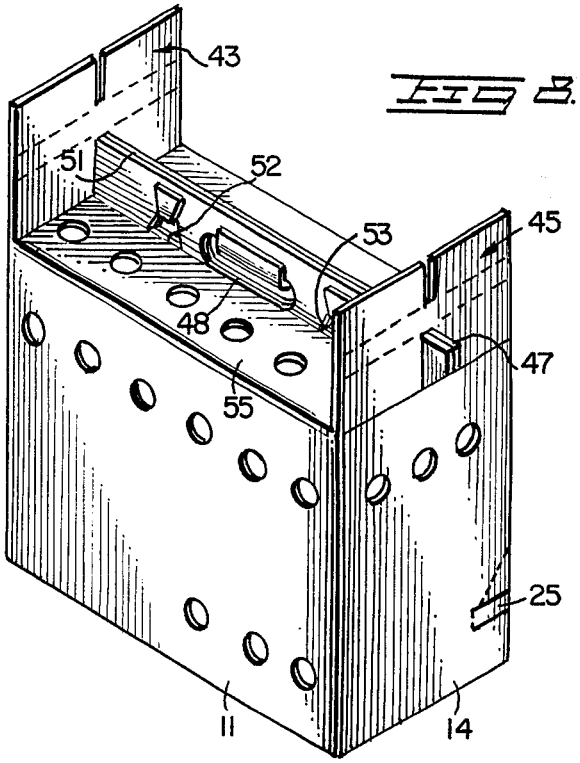

Referring particularly to the drawing, FIG. 1 illustrates a blank of paperboard or the like which is cut and scored to define the different panels and features of the shipping container of the present invention. The blank 10 comprises a pair of side walls 11, 13 and a pair of end walls 12, 14 each separated from one another by the fold lines 17, 18 and 19. Attached to side wall 11 along a fold line 16 is a glue lap 15 which is ultimately adhered or attached to end wall 14 when the shipping container is formed. Each of the side and end walls contain identifying marks 20 where ventilation openings can be selectively cut from the blank. Further, the blank is cut and scored along fold line 17 to define a means for retaining a cup or other feeding/watering receptacle in side the finally assembled container. For this purpose, a pair of parallel cut lines 21, 22 are applied to walls 11 and 12 and bounded by scored fold lines 23, 24 to form a strap element 25. The strap element 25 is pushed inside the assembled shipping container and encircles the cup or other receptable 26 (see FIG. 10) to retain it in place. In addition, to permit access to the cup 26 from the exterior of the shipping container, a removable panel 27 is arranged above the strap element 25 in the blank as defined by the intersecting perforated lines 28, 28'. The removable panel 27 is preferably positioned adjacent the strap 25 and is symetrically oriented around the fold line 17 but could just as readily be spaced from the strap 25 where desired. In operation, the cup 26 is positioned between the walls 11 and 12 with strap 25 extending around and retaining the cup in place. Later, when it is desired to fill the cup from the exterior of the container, the panel 27 is removed by breaking the perforations at 28, 28'.

Closure panels 29–32 for the bottom of the shipping container are positioned at the bottom of blank 10 and are preferably attached thereto as follows. Panel 29 is attached to side wall 11 along a fold line 33, panel 30 is attached to panel 31 by a fold line 34, panel 31 is attached to side wall 13 by a fold line 35 and panel 32 is attached to panel 31 by a pair of spaced fold lines 36, 37 and to end wall 14 by a partially cut line 38 formed by a knicked knife as well known in the trade. Meanwhile, panel 30 is separated from panel 29 and end wall 12 by cut lines 39 and 40 respectively and further includes a cut out 41 at the lower edge thereof. The cut out 41 is added to the blank only as a matter of convenience and serves to allow strap 25 to be easily pushed inside the shipping container for holding cup 26. The partially cut line 38 formed by a knicked knife permits the blank to be folded and lay flat when glue lap 15 is adhered to end wall 14. Subsequently, during the set up of the container from the knocked down condition, the knicks are broken as will be later described. The double scores 36, 37 between panels 31, 32 permit the fold to take place along fold line 19 without putting undue stress on the knicks at 38 to prematurely break their attachment. After gluing, the blank is shipped to the user in the knocked down condition where it is set up for use.

FIGS. 2–6 show the different steps for assembling the bottom of the shipping container. First, the glued blank is squared to its useable shape as shown in FIG. 2, and the knicks at 38 are broken for the first folding step. For this purpose, panel 29 is folded around fold line 33 and inside the container to lie against side wall 11 as shown in FIG. 3. Next, panels 30 and 32 are folded about fold lines 34 and 36, 37 respectively to lie against panel 31 as shown in FIG. 4 and then the combined panels 31, 30, 32 are folded around about fold lines 35 to form the bottom of the container as shown in FIG. 5. The next step in constructing the bottom of the shipping container is shown in FIG. 6 where the squared container is arranged in an upright position. At this point, with panel 29 still folded up against side wall 11, the panels 30 and 32 are folded up against their respective end walls 12, 14 and panel 29 is folded down to overlie panel 31 and produce a double thick bottom. Finally, panels 30 and 32 are folded down so as to overlie panels 31 and 29 and produce ultimately a triple wall bottom. Each of the panels 31, 29 and 30, 32 can be secured to one another or not as desired or required.

The top closure flaps for the shipping container are shown as being attached to the top of blank 10 in FIG. 1, and as illustrated are cut and scored to form an integral handle portion and top locking feature. The top closure flaps comprise flaps 42–45 each attached to their respective side and end wall along fold line 46. Flaps 42 and 44 are substantially identical and together form the integral carrying handle for the shipping container. Each flap 42, 44 contains indicia 20 for marking the location of ventilation openings where required. In addition, each flap 42, 44 has symmetrically formed slots 46, 46' as shown inboard of symmetrical hook-like projections 47, 47' at each end thereof. Flap 42 is divided into a main portion 55 and a riser portion 51 by a fold line 56. The main portion 55 serves as the top cover for the shipping container and the riser portion 51 constitutes one part of the integral handle for the container. The riser portion 51 contains cuts and scores which form the male portions of locking means for locking the handle parts together consisting of an oversize handhole flap 48 and a pair of rhomboid shaped locking tabs 52, 53. Each of these elements are only partially cut from the riser portion 51 and remain attached thereto along scored fold lines as conventionally known in the trade. For instance handhole flap 48 is attached to portion 51 along a fold line 49 and includes a central portion and two end portions separated from the central portion along fold lines 50. Similarly, flap 44 is divided into a main portion 57 and a riser portion 54 by a fold line 58. The riser portion 54 of flap 44 contains matching cuts and scores which forms the female portions of the locking elements and tabs described in riser portion 51 of the flap 42. For instance, the cut outs 59 and 60 match the locking tabs 52, 53 and the handhole cut out 61 matches the handhole flap 48 except for being normal size or slightly smaller than flap 48. The end wall closure flaps 43, 45 are substantially symmetrical and each consists of three parts 62, 63, 64 and 65, 66, 67 respectively. Each of these parts are divided from the next by scored fold lines 68, 69 and 70, 71 respectively. Further, each of the innermost parts 64 and 67 of flaps 43, 45 contain cut outs 72, 73 which ultimately cooperate with the projections 47, 47' of flaps 42, 44 as disclosed hereinafter. In addition, each of the outermost parts 62, 65 of flaps 43, 45 contain slots 74, 75 which ultimately cooperate with the slots 46, 46' of flaps 42, 44 as disclosed hereinafter.

Figure 9:
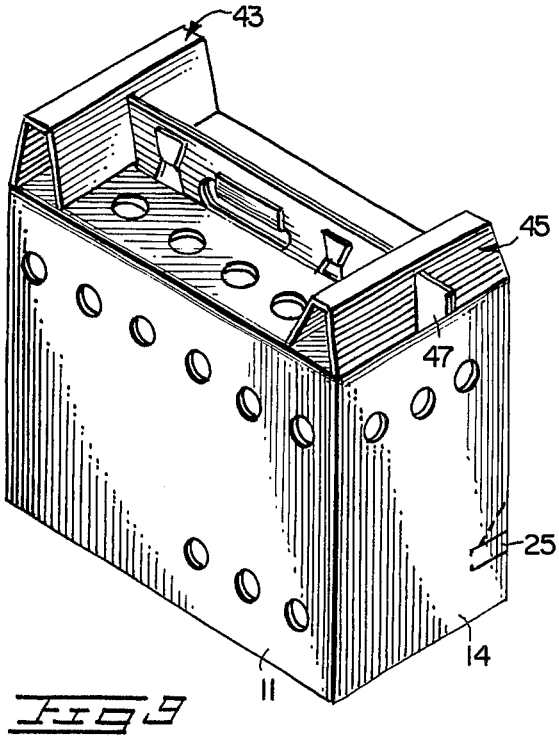

FIGS. 7–9 show the different steps for closing the top of the shipping container. In FIG. 7, the top flaps 43, 45 are folded out of the way and flaps 42, 44 are folded over the top of the container to bring riser portions 51 and 54 into face-to-face contact. At this point, the locking tabs in the handle portion formed by risers 51 and 54 are interengaged. FIG. 8 shows flaps 43, 45 folded up with the projections 47, 47' of risers 51, 54 inserted in their cooperating slots 72, 73 in flaps 43, 45. Finally, FIG. 9 shows flaps 43, 45 folded down and over the riser portions 51, 54 with the slots 74, 75 of flaps 43, 45 inserted in their cooperating slots 46, 46' in risers 51, 54. Thus, as shown in FIG. 9, the shipping container is completely closed and ready for transporting the small animal contained therein.

Figure 10:
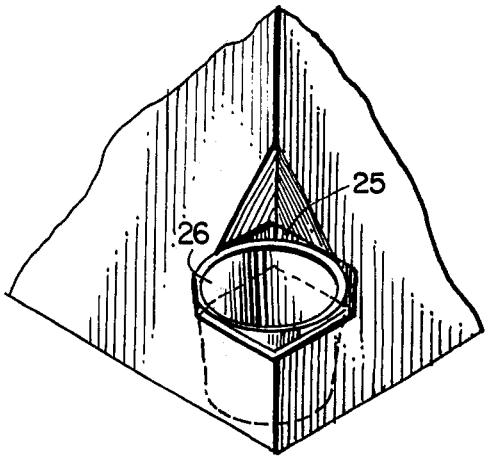

FIG. 10 illustrates the arrangement for retaining a cup or other receptacle 26 inside one corner of the shipping container for serving water or food to the animal. The cup 26 is retained in position by strap 25 which is pushed inside the shipping container. Subsequently, when access is desired to the cup 26 from outside the shipping container, the panel 27 is removed by breaking the perforations at 28, 28'.

It may be seen that the shipping container of the present invention is highly advantageous as a more economical and lighter weight carrying case for transporting small animals than those known in the art. The shipping container is constructed from paperboard or the like at a nominal cost and with ordinary container forming machinery to replace the known wooden crates normally used for transporting small animals. The weight of the container and the animal is transmitted through the integral handle in a practical and effective manner so that undue strain on any one part of the container is eliminated. The closure for the shipping container is secure yet it can quickly be opened and even reclosed when desired. Further, even though only one embodiment of the invention has been fully disclosed, changes in the details illustrated could readily be made within the scope of the appended claims.

I claim:

1. A shipping container for small animals prepared from a single blank of paperboard or the like and having an integral handle and an effective top closure locking means comprising:

a. opposed pairs of main and side walls foldably connected to define a tube;

b. closure panels foldably connected to the lower ends of said main and side walls consisting of a pair of full width panels connected to said main walls and a pair of half width panels connected to said side walls to define a triple wall bottom for said shipping container;

c. closure flaps foldably attached to the upper ends of said main and side walls to define a top closure for said shipping container and an integral handle element, said top closure flaps further comprising a pair of substantially identical first flaps attached to the opposed main walls, each of said first flaps including main portions for covering the top of said shipping container and riser portions for forming the integral handle element of said shipping container wherein each of said riser portions each further contain a pair of matching male and female locking tabs and slots, a matching handhole cut out and handhole flap with locking tabs, a pair of hook-like projections at each end thereof which engage matching slots in said symmetrical second top closure flaps and a pair of slots inboard of said hook-like projections which engage matching slots in the ends of said second symmetrical second top closure flaps, and a pair of symmetrical second flaps attached to the opposed side walls, each of said second flaps including three separate panels that are folded over and engage the riser portions of said first flaps; and, d. means cut from two adjacent main and side walls of said shipping container near the bottom of said shipping container for retaining a feeding/watering receptacle in the finally assembled container, said means further including a removable access panel for said feeding/watering receptable formed in the adjacent walls of said shipping container.

2. The shipping container according to claim 1 wherein said symmetrical second top closure flaps each consist of a first panel attached to a respective side wall, said first panel including a full width slot located centrally thereof for engaging and retaining the hook-like projections on the riser panels of said first flaps, a second intermediate panel foldably attached to said first panel and a third end panel foldably attached to said second panel and including a centrally located slot in the free edge thereof for engaging the riser panel slots positioned inboard of the riser hook-like projections.

3. The shipping container according to claim 2 wherein the means for retaining the feeding/watering receptacle in the finally assembled container further comprises a pair of parallel and spaced apart cut lines in two adjacent walls of said container said cut lines being perpendicular to and extending equidistant on each side of a fold line connecting said adjacent walls, said cut lines being connected together at each end by a pair of score lines to form a strap element, said strap element being adapted to encircle and retain the feeding/watering receptacle inside the assembled shipping container.

4. The shipping container according to claim 3 wherein the removable access panel for said feeding-/watering receptable is located above said strap element and is formed by a pair of intersecting perforated lines symmetrically oriented about the fold line connecting said adjacent walls.

* * * * *